US005947472A

United States Patent [19]

Tang

[11] Patent Number: 5,947,472

[45] Date of Patent: Sep. 7, 1999

[54] DOUBLE DRAGON WHEEL

[76] Inventor: Matthew Tang, 1525 Ocean Ave., Pleasantville, N.J. 08232

[21] Appl. No.: 08/870,462

[22] Filed: Jun. 6, 1997

[51] Int. Cl.[6] ..... A63F 5/00

[52] U.S. Cl. ..... 273/142 R

[58] Field of Search ..... 273/142 R, 143 R, 273/142 F, 142 A, 142 D, 142 E, 274

[56] References Cited

U.S. PATENT DOCUMENTS

| | | | |
|---|---|---|---|
| D. 163,281 | 5/1951 | Haupenthal | 273/142 E X |
| 1,578,412 | 3/1926 | Ewig | 273/142 E |
| 1,632,673 | 6/1927 | Paulus et al. | 273/142 R |
| 1,670,692 | 5/1928 | Rosan | 273/142 F |
| 1,925,924 | 9/1933 | Hummel | 273/142 E X |
| 2,036,718 | 4/1936 | Potter | 273/142 R |
| 2,721,082 | 10/1955 | Hunold | 273/142 F |
| 4,149,728 | 4/1979 | Thompson | 273/142 E X |
| 4,337,945 | 7/1982 | Levy | 273/142 E |
| 5,540,442 | 7/1996 | Orselli et al. | 273/142 E X |
| 5,636,838 | 6/1997 | Caro | 273/142 E |

*Primary Examiner*—William E. Stoll
*Attorney, Agent, or Firm*—Larson & Taylor

[57] ABSTRACT

The present invention provides a game board on which to play an entertainment game. The game consists of 12 zodiac animal symbols and 13 playing card characters, which are Ace Diamond, Two Diamond, Three Diamond, Four Diamond, Five Diamond, Six Diamond, Seven Diamond, Eight Diamond, Nine Diamond, Ten Diamond, Jack Diamond, Queen Diamond, and King Diamond. This game utilizes a rotatable wheel, like a Big 6 Wheel, and a game board like that used on a Roulette table. The game is a combination of Roulette and Big 6 that is played with zodiac animal symbols and playing card characters.

2 Claims, 2 Drawing Sheets

DOUBLE DRAGON WHEEL

BACKGROUND OF INVENTION

1. Field of Invention

This present invention relates to a game apparatus, which utilizes a rotatable wheel for playing an entertainment game.

2. Description of Prior Art

Although many varieties of board games have been disclosed, prior art board games did not use the popular features shown in this invention.

SUMMARY OF THE INVENTION

The present invention provides a game board apparatus for playing an entertainment game. The game board table has 27 separate areas consisting of 12 zodiac animal symbols, and 13 playing card characters, which are Ace Diamond, Two Diamond, Three Diamond, Four Diamond, Five Diamond, Six Diamond, Seven Diamond, Eight Diamond, Nine Diamond, Ten Diamond, Jack Diamond, Queen Diamond, and King Diamond. The rotatable wheel has 25 separate areas which consist of 12 zodiac animal symbols, and 13 playing card characters, which are Ace Diamond, Two Diamond, Three Diamond, Four Diamond, Five Diamond, Six Diamond, Seven Diamond, Eight Diamond, Nine Diamond, Ten Diamond, Jack Diamond, Queen Diamond, and King Diamond. A player spins the wheel. When the wheel stops, a fixed pointer will identify a winning symbol or characters on the wheel. If any player has selected the same symbol or character on the game board as the one indicated on the wheel by the pointer, that player wins.

It is the objective of the present invention to provide a new and improved game board apparatus with interesting and popular features. In addition, it is simple and easy to understand.

DESCRIPTION OF THE PREFERRED EMBODIMENT

Figure 1:
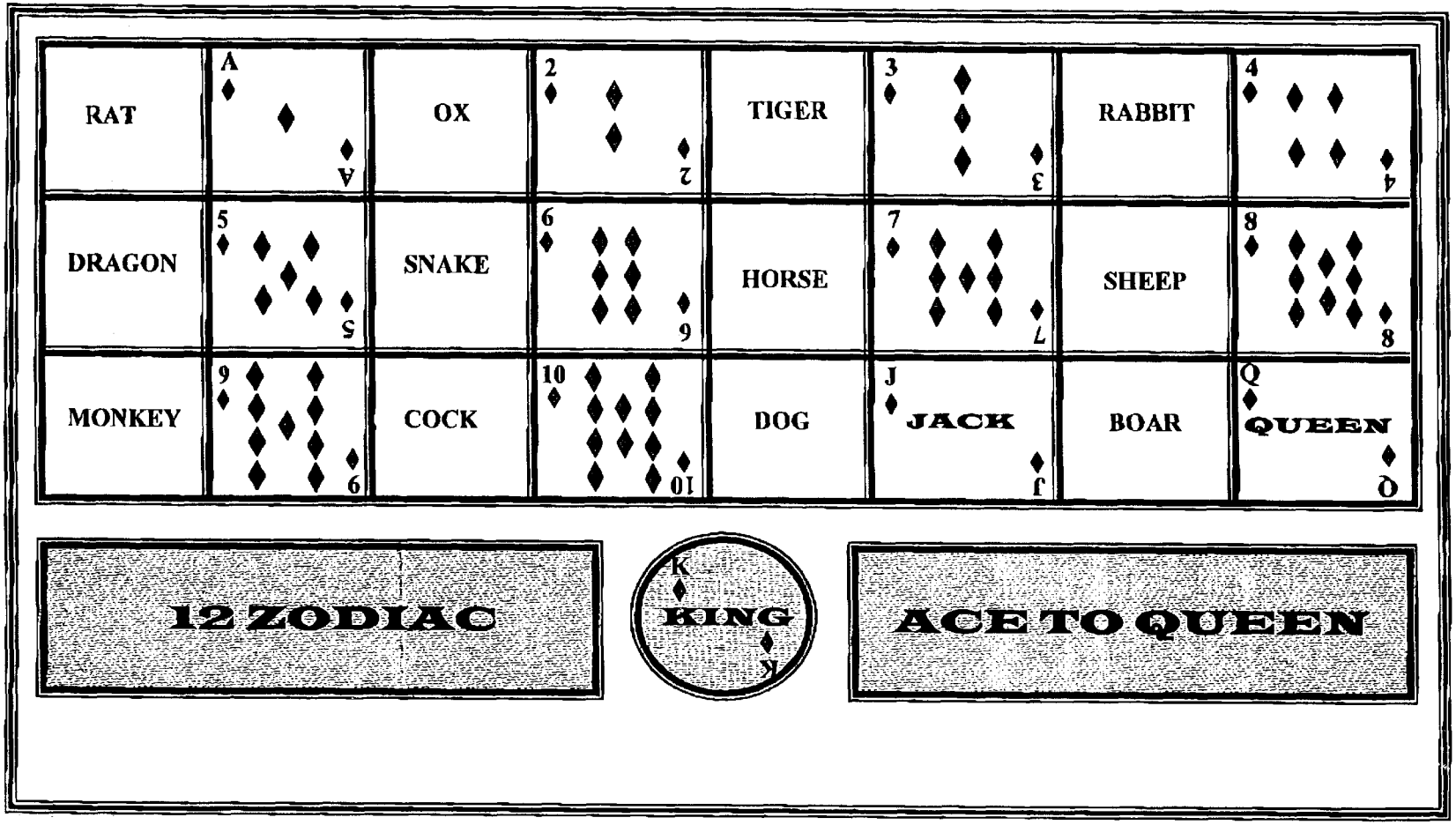
FIG. 1 shows the garne's table layout.

FIG. 1 shows the following configuration:

Rat is next to ACE Diamond, ACE Diamond is next to OX, OX is next to Two Diamond, Two Diamond is next to Tiger, Tiger is next to Three Diamond, Three Diamond is next to Rabbit, Rabbit is next to Four Diamond, Four Diamond is next to Dragon, Dragon is next to Five Diamond, Five Diamond is next to Snake, Snake is next to Six Diamond, Six Diamond is next to Horse, Horse is next to Seven Diamond, Seven Diamond is next to Sheep, Sheep is next to Eight Diamond, Eight Diamond is next to Monkey, Monkey is next to Nine Diamond, Nine Diamond is next to Cock, Cock is next to Ten Diamond, Ten Diamond is next to Dog, Dog is next to Jack Diamond, Jack Diamond is next to Boar, and Boar is next to Queen Diamond. It also shows 12 Zodiac, King Diamond, and Ace To Queen areas.

Figure 2:
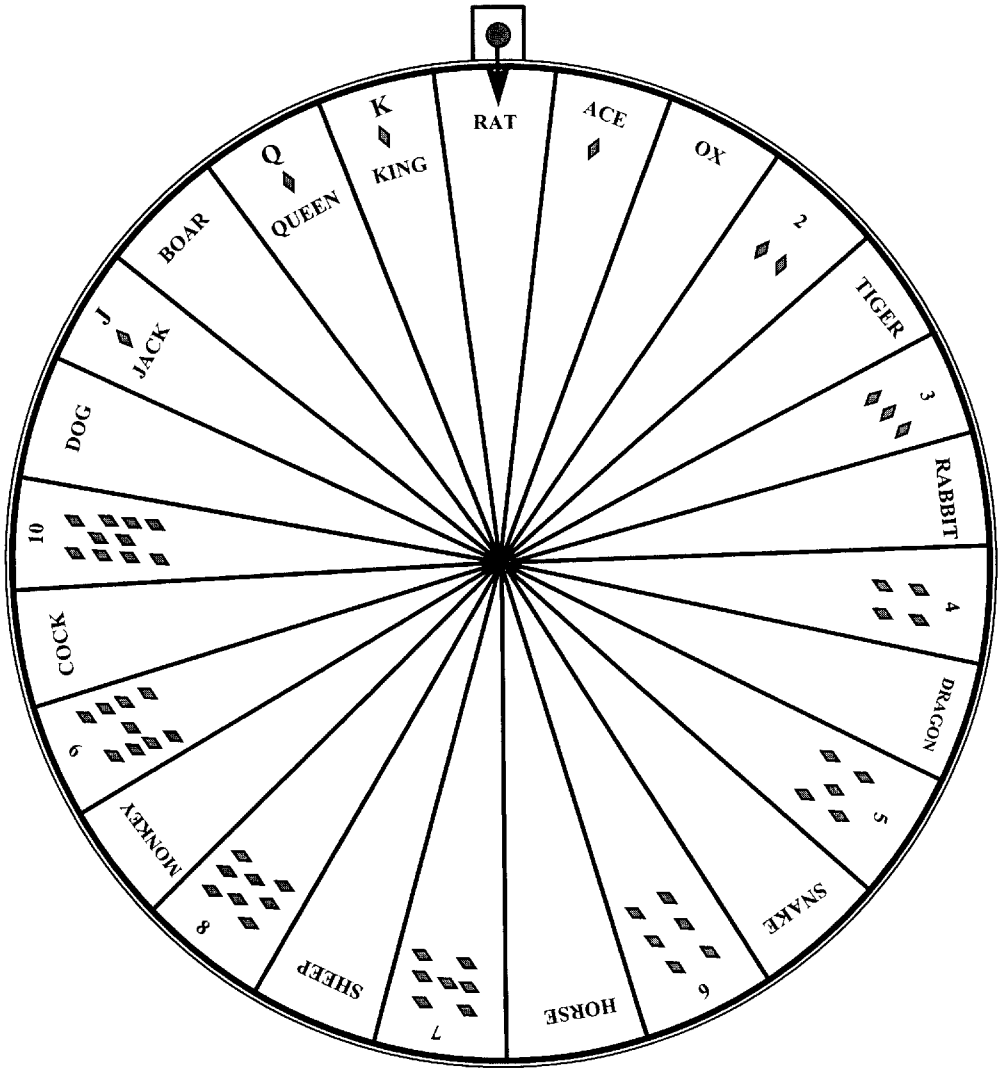
FIG. 2 shows the game's wheel layout.

FIG. 2 shows the following configuration:

Rat is next to ACE Diamond, ACE Diamond is next to OX, OX is next to Two Diamond, Two Diamond is next to Tiger, Tiger is next to Three Diamond, Three Diamond is next to Rabbit, Rabbit is next to Four Diamond, Four Diamond is next to Dragon, Dragon is next to Five Diamond, Five Diamond is next to Snake, Snake is next to Six Diamond, Six Diamond is next to Horse, Horse is next to Seven Diamond, Seven Diamond is next to Sheep, Sheep is next to Eight Diamond, Eight Diamond is next to Monkey, Monkey is next to Nine Diamond, Nine Diamond is next to Cock, Cock is next to Ten Diamond, Ten Diamond is next to Dog, Dog is next to Jack Diamond, Jack Diamond is next to Boar, Boar is next to Queen Diamond, and Queen Diamond is next to King Diamond.

As depicted in FIG. 2, the game involves betting on one or more of the 12 zodiac animal symbols or 13 playing card characters listed below:

| | |
|---|---|
| 1. | Rat |
| 2. | ACE Diamond |
| 3. | Ox |
| 4. | Two Diamond |
| 5. | Tiger |
| 6. | Three Diamond |
| 7. | Rabbit |
| 8. | Four Diamond |
| 9. | Dragon |
| 10. | Five Diamond |
| 11. | Snake |
| 12. | Six Diamond |
| 13. | Horse |
| 14. | Seven Diamond |
| 15. | Sheep |
| 16. | Eight Diamond |
| 17. | Monkey |
| 18. | Nine Diamond |
| 19. | Cock |
| 20. | Ten Diamond |
| 21. | Dog |
| 22. | Jack Diamond |
| 23. | Boar |
| 24. | Queen Diamond |
| 25. | King Diamond |

The rules of the game are as follow:

There are seven types of payback: Straight Up, Split, Street, Corner, Six Line, 12 Zodiac, and Ace To Queen. The following define the paybacks:

1. The Straight Up is any one of the 12 zodiac animal symbols or any one of the 13 playing card characters. The reward is 23 to 1.
2. The Split is any two zodiac animal symbols, two playing card characters, or one zodiac animal symbol and one playing card character. The reward is 11 to 1.
3. The Street is any three zodiac animal symbols or any three playing card characters. The reward is 7 to 1.
4. The Corner is any of the two zodiac animal symbols and two playing card characters forming the corner. The reward is 5 to 1.
5. The Six Line is any three zodiac animal symbols and three playing card characters forming the line. The reward is 3 to 1.
6. The 12 Zodiac is any one of the zodiac animal symbols. The reward is 1 to 1.
7. The Ace To Queen. The reward is 1 to 1.

Before the wheel starts to spin, players place a bet on any one of the 12 zodiac animal symbols or 13 playing card characters. The rotating wheel is spun randomly once to identify one lucky winner. When the wheel randomly stops at any one of the 12 zodiac animal symbols or 13 playing card characters the player(s) that bet on that particular zodiac animal symbol or playing card character will be rewarded 23 chips for every one chip bet. Unless the player bets on one of the SPLIT intersections which consists of any two zodiac animal symbols, two playing card characters, or one zodiac animal symbol and one playing card character, the reward for the SPLIT intersection is 11 chips for every one chip bet. For example, a player bets one chip on Tiger and one chip on Horse. After the wheel stops spinning and the pointer points to Tiger, than the player will be rewarded 23 chips for the one chip bet on Tiger. A player can bet on as many zodiac animal symbols or playing card characters as desired. For the SPLIT intersection, assuming that a player bets one chip on Rat and Dragon. When the wheel stops spinning and it points to either Rat or Dragon, then the player will be rewarded 11 chips for the one chip bet.

Although the foregoing has been a description and illustration of specific embodiments of the invention, various modifications and changes thereto can be made by persons skilled in the art without departing from the scope and spirit of the invention as defined by the following claims:

I claim:

1. A game board apparatus for playing an entertainment game involving one or more players comprising:

(a) a game board with a playing surface, (b) the playing surface has 12 zodiac animal symbols, 13 playing card characters, which are Ace Diamond, Two Diamond, Three Diamond, Four Diamond, Five Diamond, Six Diamond, Seven Diamond, Eight Diamond, Nine Diamond, Ten Diamond, Jack Diamond, Queen Diamond, and King Diamond, (c) a rotatable wheel that is similar to a Big 6 Wheel and has the same 12 zodiac animal symbols and 13 playing card characters, (d) the wheel providing a 0.48 chance of hitting one of the 12 zodiac animal symbols, (e) the wheel providing a 0.52 chance of hitting one of the 13 playing card characters, (f) the 12 zodiac animal symbols and 13 playing card characters are:

Rat, ACE Diamond, Ox, Two Diamond, Tiger, Three Diamond, Rabbit, Four Diamond, Dragon, Five Diamond, Snake, Six Diamond, Horse, Seven Diamond, Sheep, Eight Diamond, Monkey, Nine Diamond, Cock, Ten Diamond, Dog, Jack Diamond, Boar, Queen Diamond, and King Diamond.

2. The game board apparatus for playing an entertainment game involving one or more players as set forth in claim 1 comprising the 12 zodiac animal symbols and 13 playing card characters for the Zodiac and Playing Cards Game wheel layout are arranged as:

Rat is next to ACE Diamond, ACE Diamond is next to OX, OX is next to Two Diamond, Two Diamond is next to Tiger, Tiger is next to Three Diamond, Three Diamond is next to Rabbit, Rabbit is next to Four Diamond, Four Diamond is next to Dragon, Dragon is next to Five Diamond, Five Diamond is next to Snake, Snake is next to Six Diamond, Six Diamond is next to Horse, Horse is next to Seven Diamond, Seven Diamond is next to Sheep, Sheep is next to Eight Diamond, Eight Diamond is next to Monkey, Monkey is next to Nine Diamond, Nine Diamond is next to Cock, Cock is next to Ten Diamond, Ten Diamond is next to Dog, Dog is next to Jack Diamond, Jack Diamond is next to Boar, Boar is next to Queen Diamond, and Queen Diamond is next to King Diamond.

* * * * *